United States Patent [19]

Sano et al.

[11] Patent Number: 4,721,153

[45] Date of Patent: Jan. 26, 1988

[54] HIGH-CHROMIUM COMPOUND ROLL

[75] Inventors: Yoshikazu Sano; Michio Haga; Toshio Okitsu, all of Kitakyushu, Japan

[73] Assignee: Hitachi Metals, Inc., Japan

[21] Appl. No.: 906,747

[22] Filed: Sep. 12, 1986

[51] Int. Cl.[4] ..... B22D 11/12; B22D 19/00

[52] U.S. Cl. ..... 164/448; 164/461; 164/98; 29/132; 29/148.4 D; 148/3; 148/15.5; 148/127; 420/15; 420/34; 428/685

[58] Field of Search ..... 164/448, 92.1, 98, 461; 29/132, 148.4 D; 148/3, 127, 15.5; 420/15, 34; 428/685

[56] References Cited

U.S. PATENT DOCUMENTS

| | | | |
|---|---|---|---|
| 3,455,372 | 7/1969 | Yamamoto | 164/92.1 |
| 4,191,599 | 3/1980 | Stickels et al. | 29/132 |
| 4,546,527 | 10/1985 | Fukuda et al. | 29/132 |
| 4,548,653 | 10/1985 | Bocquet et al. | 29/132 |
| 4,604,781 | 8/1986 | Rankin III | 29/402.07 |

*Primary Examiner*—Nicholas P. Godici

*Assistant Examiner*—Samuel M. Heinrich

*Attorney, Agent, or Firm*—Finnegan, Henderson, Farabow, Garrett & Dunner

[57] ABSTRACT

A compound roll for rollng composed of a shell made of high-chromium cast iron and a core made of cast or forged steel. The shell has a large residual compressive stress. The high-chromium cast iron shell has a composition by weight of 2.0–3.5% C, 0.5–1.5% Si, 0.4–1.5% Mn, 8–25% Cr, 0.5–3.0% Mo, 1.5% or less Ni and the balance being essentially Fe for hot rolling, and 2.5–3.5% C, 0.5–1.5% Si, 0.4–1.5% Mn, 0.5–3.0% Ni, 8–25% Cr, 1.0–5.0% Mo and the balance being essentially Fe for cold rolling. The shell's Shore hardness is 70 or more for hot rolling and 90 or more for cold rolling, and the core's tensile strength and elongation are 55 kg/mm$^2$ or more and 1.0% or more, respectively. The residual compressive stress of the shell is 20 kg/mm$^2$ or more and serves to prevent cracks from penetrating into the depths of the shell, thereby preventing spalling effectively. This compound roll can be manufactured by a shell casting method.

14 Claims, 2 Drawing Figures

HIGH-CHROMIUM COMPOUND ROLL

BACKGROUND OF THE INVENTION

The present invention relates to a compound roll composed of a shell and a core, and more particularly to a compound roll composed of a high-chromium cast iron shell and a cast or forged steel core.

Rolls for hot and cold rolling are conventionally formed from alloy cast iron or hardened forged steel, but they suffer from various problems such as low resistance to wear and failure. For the purpose of improving the hardness of roll shells, high-chromium cast iron compound rolls were developed. A typical high-chromium cast iron compound roll is composed of a high-chromium cast iron shell and a cast iron or spheroidal graphite cast iron core. It was manufactured by a centrifugal casting method. See J. Honda et al.,"Compound Cast Rolls for Steel Rolling Mills," IMONO (Casting), Vol. 54, pp. 44–50, 1982; H. Muller et al., "High-Chrome Work rolls in a Modern Hot Strip Mill," Iron and Steel Engineer, pp. 63–70, Oct. 1975; and M. Grounes, "New Roll Types with Superior Performance," Iron and Stee Engineer, pp. 42–49, April 1979.

Particularly for hot rolling, work rolls have been increasingly required to have high resistance to wear, failure, adhesion of rolled materials and surface roughening from the viewpoint of improving rolling operation and efficiency. For these purposes, high-chromium cast iron roll appears to be promising.

And for cold rolling, much higher stress is applied to the compound rolls in operation, so that the cores of the compound rolls should have extremely good mechanical properties.

In addition, conventional four high mills comprising a pair of work rolls and a pair of back-up rolls, either for hot rolling or for cold rolling, have been increasingly replaced by six high mills having intermediate rolls between work rolls and back-up rolls, or mills having work rolls which can be shifted, in order to apply higher pressure to metal sheets to be rolled. Because an extremely high load is applied to the work rolls, the maximum contact pressure of the work rolls can reach, for instance, up to 240 kg/mm$^2$ as compared with 160 kg/mm$^2$ for the four high mills. As a result, spalling has become a serious problem.

At the same time, in such high-pressure mills, a larger bending force is applied to the shafts of the work rolls, so that the roll shafts have been required to have higher mechanical strength.

For such purposes, a conventional centrifugal casting method has turned out to be unsatisfactory, because it failed to provide compound rolls having sufficiently hard shells and sufficiently tough cores. Specifically, high-chromium compound rolls manufactured by the centrifugal casting method had inevitably cast cores, and the cores' mechanical properties were lower than expected. For instance, even with spheroidal graphite cast iron, the cores had tensile strength of 35–55 kg/mm$^2$ and elongation of 0.2–0.5%. It has turned out that the deterioration of mechanical properties of the cores is caused by diffusion of chromium contained in the shells into the cores during the casting of molten core materials, and that this phenomenon is unavoidable in the centrifugal casting method. Accordingly, extremely high rolling pressure could not be achieved with high-chromium compound rolls manufactured by the centrifugal casting method.

As for the shells, although a proper heat treatment can increase Shore hardness of high-chromium cast iron, the shells of the high-chromium compound rolls manufactured by the centrifugal casting method can reach Shore hardness of only 80–90 at highest. The reason therefor is that since a hardening treatment accompanied by rapid cooling for martensitic transformation may lead to the breakage of the rolls, tempering has to be carried out several times to decrease a large amount of residual austenite, inevitably causing the softening of the shells by tempering to a large extent. Thus, the high-chromium cast iron compound rolls manufactured by the centrifugal casting method could not attain sufficient wear resistance.

In view of the above problems with the centrifugal casting method, a method of forming a shell around a core by casting a shell material around the core was recently developed.

U.S. Pat. No. 3,455,372 issued to Yamamoto on July 15, 1969 discloses a continuous padding method using high frequency current. This method comprises preheating the surface of a core material by moving the core material up and down through a mold assembly composed of a heating mold, a buffer mold and a cooling mold, and after returning the core material to a predetermined position, moving it downwardly and slowly through the mold assembly while pouring a melt of padding material into the gap between the core material and the mold assembly, whereby the melt is bonded to the surface of the core material, cooled to some extent within the buffer mold, and further cooled and solidified rapidly within the cooling mold to form a layer of pad on the surface of the core material.

This method, which may be called simply"shell casting method," can provide a compound roll composed of a hard shell and a tough core. High-chromium cast iron compound rolls manufactured by the shell casting method are subject to heat treatment. However, a usual heat treatment comprising hardening and tempering fails to achieve the maximum properties which these compound rolls potentially have. Particularly, spalling remains to be a serious problem for the high-chromium cast iron compound rolls thus manufactured.

Spalling is a fatigue type of failure which can be caused by severe mechanical stress. Most defects of this type are greater at depth than at the surface. In most of these cases, the failure is fatal, with a crack extending to the shell/core interface.

OBJECT AND SUMMARY OF THE INVENTION

An object of the present invention is, therefore, to provide a compound roll composed of a high-chromium cast iron shell and a forged or cast steel core, which has a highly improved resistance to spalling without deteriorating its resistance to wear, surface roughening, adhesion of rolled materials and cracking.

Another object of the present invention is to provide a compound roll for hot and cold rolling composed of a high-chromium cast iron shell and a forged or cast steel core, which in addition to the above characteristics, can withstand extremely high rolling pressure and bending force without suffering from any breakage at neck portions thereof.

In view of the above object, the inventors have done intense research. As a result, it has been found that spalling grows circumferentially, starting from cracks such as heat cracks, that it also depends on the microstructural defects and the shapes of carbides of the shell, but their influence is much smaller than that of cracks, and that to prevent the cracks from growing radially deep in the shell, a large compressive stress is highly effective. The present invention is based on this finding.

That is, the compound roll according to the present invention is composed of a shell made of high-chromium cast iron and a core made of forged or cast steel, the shell having a large residual compressive stress.

BRIEF DESCRIPTION OF THE INVENTION

FIG. 1 is a cross-sectional view of a mold assembly for manufacturing the compound roll according to the present invention; and FIG. 2 is a graph showing heat treatment conditions for providing the shell of the compound roll with a large residual compressive stress.

DESCRIPTION OF THE PREFERRED EMBODIMENTS

Figure 1:
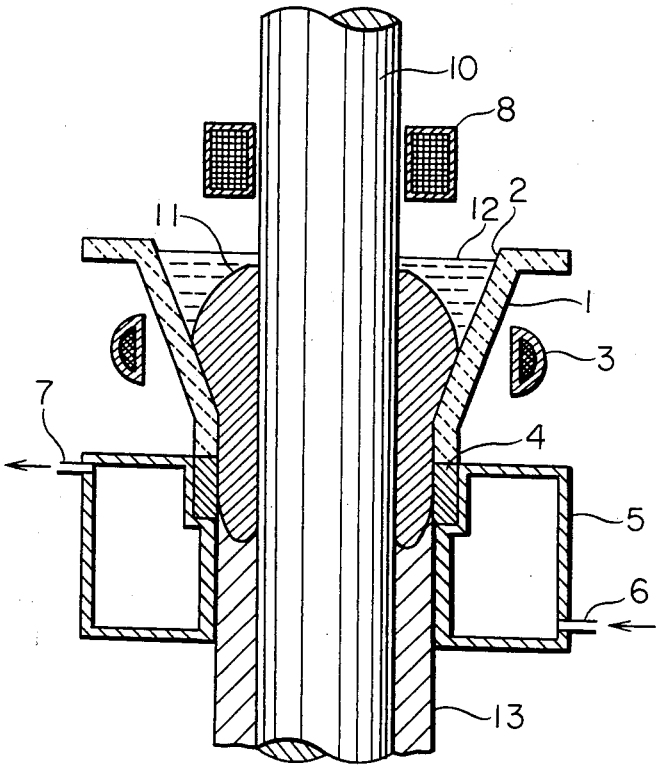

High-chromium cast iron used as a shell material for the compound roll according to the present invention should have high resistance to wear, adhesion of rolled materials and surface roughening for hot rolling. Specifically, the high chromium cast iron consists essentially, by weight, of 2.0–5% of C, 0.5–1.5% of Si, 0.4–1.5% of Mn, 8–25% of Cr, 0.5–3.0% of Mo, 1.5% or less of Ni and the balance being essentially Fe. Up to 10 weight % of V may be contained. With this composition, the shell of the compound roll for hot rolling has Shore hardness of 70 or more, and the Shore hardness drop across the depth of the shell is only 3 or less per 100mm. As for the core, it is made of cast or forged steel having tensile strength of 55 kg/mm$^2$ or more and elongation of 1.0% or more. The shell and the core are metallurgically bonded to each other by the shell casting method with bonding strength at least equal to or higher than the strength of either weaker one of the shell and the core.

With respect to the above shell composition of the compound roll for hot rolling, a well-balanced combination of C and Cr is important to precipitate $M_7C_3$ carbides in the microstructure of the shell.

First of all, C is 2.0–3.5 weight %. When it is less than 2.0 weight %, the shell of the compound roll does not have sufficient wear resistance because it cannot form a sufficient amount of carbides. However, when it exceeds 3.5 weight %, the shell shows poor mechanical properties due to the excessive formation of carbides.

Cr is 8–25 weight %. When it is less than 8 weight %, $Fe_3C$ carbides precipitate so that the shell has poor resistance to wear and spalling and also has low toughness. However, when it exceeds 25 weight %, the shapes of $M_7C_3$ carbides are deformed, leading to poor mechanical properties. To ensure uniform dispersion of the $M_7C_3$ carbides for enhancing wear resistance and toughness, Cr should be 8–25 weight %.

Si is added as a deoxidizer. When it is less than 0.5 weight %, it cannot provide sufficient deoxidizing effect. But when it exceeds 1.5 weight %, it deteriorates the mechanical properties of the shell. Thus, Si is 0.5–1.5 weight %.

Mn is reacted with S to form MnS, thereby preventing the brittleness of the shell due to S. When it is less than 0.4 weight %, such effect is insufficient, and when it exceeds 1.5 weight %, the shell has poor resistance to heat cracking.

Mo is necessary for enhancing a high-temperature hardness of the shell. When it is less than 0.5 weight %, such effect is insufficient, but when it exceeds 3.0 weight %, residual austenite undesirably remains. Thus, Mo is 0.5–3.0 weight %.

In order that the shell has high Shore hardness which drops only 3 or less per 100mm across the depth of the shell, Ni should be contained in the shell. However, Ni serves to decrease the resistance of the shell to adhesion of rolled materials. Particularly, when Ni is more than 1.5 weight %, residual austenite exists in the shell, leading to poor resistance to adhesion of rolled materials and surface roughening. Thus, the amount of Ni added to the shell is limited to 1.5 weight % or less.

The hardness drop of the shell in a radial direction which would be brought about by the limitation of the Ni content can be prevented by a special heat treatment as described hereafter.

The shell of the compound roll for hot rolling may contain up to 10 weight % of V to improve wear resistance thereof by the formation of VC carbides. However, when it exceeds 10 weight %, the amount of $M_7C_3$ carbides decreases, resulting in the decrease in wear resistance.

With respect to the core of the compound roll for hot rolling, it is made of cast or forged steel having tensile strength of 55 kg/mm$^2$ or more and elongation of 1.0% or more. This core enables the compound roll to withstand high rolling pressure and bending force which are concentrated at neck portions thereof.

On the other hand, the compound roll for cold rolling according to the present invention is composed of a shell made of high-chromium cast iron and a core made of cast or forged steel, the high-chromium cast iron shell consisting essentially, by weight, of 2.5–3.5% of C, 0.5–1.5% of Si, 0.4–1.5% of Mn, 0.5–3.0% of Ni, 8–25% of Cr, 1.0–5.0% of Mo and the balance being essentially Fe. Up to 10 weight % of V may be contained in the shell. The shell has a surface hardness of 90 or more (Shore hardness), which drops only 3 or less per 100 mm across the depth of the shell. The core made of cast or forged steel has tensile strength of 55 kg/mm$^2$ or more and elongation of 1.0% or more. The shell and the core are metallurgically bonded to each other with bonding strength at least equal to or higher than the strength of either weaker one of the shell and the core.

Since the compound roll for cold rolling is subjected to higher rolling pressure and bending force, the shell should have excellent resistance to wear and failure such as cracking and spalling. For this purpose, the high-chromium cast iron for cold rolling contains a larger amount of Mo than for hot rolling. Specifically, Mo is 1.0–5.0 weight %. This range of Mo enables the shell to have Shore hardness of 90 or more.

It is to be noted that Ni is 0.5–3.0 weight %. The upper limit of Ni is higher for the compound roll for cold rolling than for that for hot rolling because adhesion of rolled materials is not so serious a problem for cold rolling. When Ni is less than 0.5 weight %, it cannot sufficiently enhance the effect of hardening treatment, but when it exceeds 3.0 weight %, the matrix of the shell tends to be austenitized, leading to lower hardness.

Of course, V may be added in an amount of up to 10 weight % for improving wear resistance.

The compound roll of the present invention, either. for hot rolling or for cold rolling, is manufactured by a so-called shell casting method. This method is typically carried out by a mold assembly shown in FIG. 1.

The mold assembly for the shell casting method comprises a heating mold 1 made of a refractory material having a funnel-shaped upper opening 2, an induction heating coil 3 provided around the heating mold 1, a graphite buffer mold 4 having the same inner diameter as that of the heating mold 1 and concentrically mounted therebeneath, and a water cooling mold 5 partially surrounding the graphite buffer mold 4 and concentrically extending therebeneath. The water cooling mold 5 has an inlet 6 and an outlet 7 through which water flows in the direction shown by the arrow. Provided concentrically above the heating mold 1 is an induction preheating coil 8.

A core 10 is inserted into the mold assembly after being preheated by the induction coil 8. Poured into the gap between the inner surface of the mold assembly and the core 10 is molten high-chromium iron 11. The molten highchromium iron 11 is covered by a flux 12 and heated while stirring by the induction heating coil 3 so that it is metallurgically bonded to the core 10. The molten high-chromium iron 11 is cooled by the water-cooling mold 5 in the vicinity of the graphite buffer mold 4. The solidified highchromium cast iron forms a shell 13 strongly bonded to the core 10. Because the core 10 is slowly moved downwardly, high-chromium iron is solidified continuously so that the shell 13 is continuously formed around the core 10. New molten high-chromium iron is replenished to make up for the consumed one.

The compound roll thus manufactured is subjected to a special heat treatment. The heat treatment for a hot rolling compound roll comprises:

(a) heating it at temperatures of 950°-1050° C. for one hour or more for hardening it; and (b) quenching it to temperatures of 550°-600° C. over 30-60 minutes.

When the hardening temperature is less than 950° C., sufficient hardening cannot be achieved, and when it is higher than 1050° C., residual austenite remains after the hardening and tempering treatment, resulting in low hardness and a small residual compressive stress. The time period for which the hardening temperature is kept may vary depending on the size of a compound roll to be heat-treated, but it is at least one hour so that precipitated carbides can be fully dissolved in the matrix.

The quenching is significant in providing the shell of the compound roll with sufficient hardness and residual compressive stress. The quenching may be carried out by air cooling, forced air cooling and mist cooling as long as the quenching rate is within the desired range. The above quenching rate turns the matrix to bainite or a mixture of bainite and martensite so that the shell can have sufficient hardness and residual compressive stress. A typical exampl e of the quenching conditions is to cool the compound roll from the hardening temperature to 600° C. for 30-60 minutes and then cool it from 600° C. to 500° C. for 60-120 minutes.

The compound roll is desirably further cooled to intermediate temperatures of 450°-550° C. at a slower rate, and then kept at the intermediate temperatures for 1-5 hours to relieve thermal stress.

The residual compressive stress is 20 kg/mm$^2$ or more for the compound roll shell for hot rolling. With this level of the residual compressive stress, heat cracks do not penetrate into the depths of the shell, so that large spalling can be effectively prevented. What is important is that the cracks do not reach the depth at which shear stress caused by contact with the opposing intermediate roll or back-up roll becomes a maximum. The depth at a maximum shear stress may vary depending on the rolling pressure, the Young's modulus of the shell and the diameter of the roll, but it is usually 2-5 mm.

Incidentally, a heat treatment of the compound roll for cold rolling comprises:

(a) heating it at temperatures of 1000°-1100° C. for one hour or more for hardening it; and (b) quenching it to temperatures of 550°-600° C. over 30-60 minutes.

The hardening temperature is somewhat higher for cold rolling than for hot rolling because the high-chromium cast iron shell has a different composition and is harder for cold rolling than for hot rolling.

Although the quenching at such a high rate from the hardening temperature is highly effective for providing the desired residual compressive stress to the compound roll shell, it has been found that quenching the compound roll continuously to lower temperatures such as room temperature sometimes results in cracking or breakage of the compound roll, particularly where it is large in size. Thus, the quenching is first slowed from 550°-600° C. to intermediate temperatures of 450°-550° C., and then stopped at the intermediate temperatures. The compound roll is desirably kept at the intermediate temperatures for 1-5 hours to relieve thermal stress to some extent.

The compound roll is then subjected to tempering at 400°-600° C. for one hour or more. The tempering serves to decrease residual austenite thereby removing strain retained in the roll. The tempering may be carried out up to three times for the compound rolls for hot rolling and up to six times for those for cold rolling, if necessary.

Incidentally, before the hardening, the matrix of the shell may be transformed to pearlite by heating the compound roll at 600°-750° C. for one hour or more. Alternatively, before pearlite transformation, the compound roll may be heated to 800°-1000° C. and then slowly cooled to temperatures of 600°-750° C. at which it is kept for one hour or more and then slowly cooled.

The compound roll subjected to the above heat treatment according to the present invention is characterized in that its shell has sufficient hardness and residual com pressive stress. Specifically, for the compound roll for hot rolling, the shell has Shore hardness of 70 or more which drops only 3 or less per 100 mm across the depth of the shell, and a residual compressive stress of 20 kg/mm$^2$ or more. And for the compound roll for cold rolling, the shell has Shore hardness of 90 or more and a residual compressive stress of 20 kg/mm$^2$ or more.

Because of the residual compressive stress in the shell, the core should have tensile strength of 55 kg/mm$^2$ or more. First of all, the compressive stress in the shell is likely to generate a tensile stress of about 20 kg/mm$^2$ or more in the core. Thermal stress is also applied to the compound roll when used for hot rolling, generating a compressive stress of 10 kg/mm$^2$ or more in the shell and a tensile stress substantially on the same level in the core. In total, 55 kg/mm$^2$ or more in tensile strength is considered necessary for the core with some margin for safety. In addition to the tensile strength, the core should also have elongation of 1.0% or more to withstand severe rolling conditions. The same level of mechanical properties are also required for the compound roll shell for cold rolling.

When the core happens to have a defect such as a void, it should have fracture toughness of at least $$\left(\frac{2}{\pi}\right) \times 55 \times \sqrt{\pi x r}\ \text{kg/mm}^{3/2}$$

wherein r is a radius of an assumptive disc equivalent to that defect, the disc being in perpendicular to the direction of tension. This fracture toughness corresponds to tensile strength of 55 kg/mm2 for the core with no void.

By the above heat treatment, the shell of the compound roll for hot rolling has Shore hardness of 70 or more and high resistance to wear, surface roughening and spalling, and that for cold rolling has Shore hardness of 90 or more and high resistance to wear, surface roughening and spalling.

The present invention will be explained in further detail by the following Examples.

EXAMPLE 1

According to a shell casting method using the mold assembly shown in FIG. 1, a compound roll of 400 mm in diameter and 1500 mm in length was manufactured from a steel core (S45C) and as a shell material high-chromium cast iron having the following composition by weight %:

C: 2.72%
Si: 0.68%
Mn: 0.98%
P: 0.03%
S: 0.02%
Ni: 1.26%
Cr: 16.4%
Mo: 1.21%
Fe: Bal.

Figure 2:
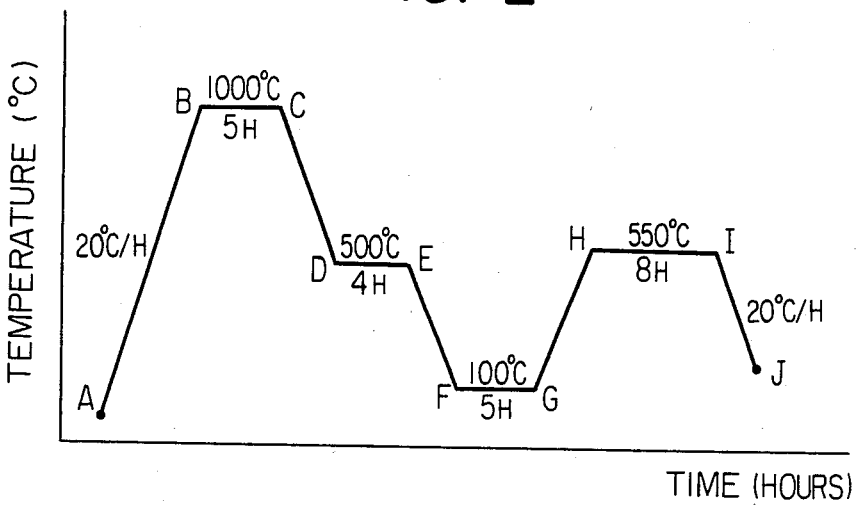

The resulting compound roll was subjected to a heat treatment as shown in FIG. 2.

AB: Heating to 1000° C. at a rate of 20° C./hour.
BC: Keeping at 1000° C. for 5 hours for hardening.
CD: Quenching from 1000° C. to 500° C. over 80 minutes.
DE: Keeping at 500° C. for 4 hours.
EF: Cooling from 500° C. to 100° C. slowly.
FG: Keeping at 100° C. for 5 hours.
GH: Heating to 550° C. at a rate of 20° C./hour.
HI: Keeping at 550° C. for 8 hours for tempering.
IJ: Cooling to room temperature slowly.

The shell had hardness Hs=76 and the core had tensile strength of 64 kg/mm.

The residual stress of the compound roll was measured by a Sachs method. The results are Outer surface (shell): −31 kg/mm$^2$
Inner portion (core): 29 kg/mm$^2$ This means that the shell was under a large compressive stress (31 kg/mm$^2$) while the core was under a tensile stress substantially on the same level (29 kg/mm$^2$).

This roll was brought into contact with an aluminum melt at 800° C. for 5 minutes by pouring the aluminum melt into a pool formed in the roll surface, and then quenched with water at 20° C. to form thermal cracks. The cracks thus formed were 1.2 mm deep. On the other hand, after the residual stress was reduced to −4 kg/mm$^2$ by cutting the roll to 200 mm long, the same thermal crack test was carried out. As a result, the resulting cracks were 17.4 mm deep, which was about 15 times as deep as where the residual stress was −31 kg/mm$^2$.

Each of these rolls was combined with a forged steel roll of 300 mm in diameter and 50 mm in length and having hardness Hs=81 to effect a spalling test under Herz pressure of 200 kg/mm$^2$. As a result, it was observed that the high-chromium compound roll having deeper cracks had a shorter spalling life.

As is clear from the above results, the compound roll according to the present invention has high resistance not only to heat cracks but also to spalling.

EXAMPLE 2

A compound roll was manufactured from a forged steel core (SCM) having a diameter of 450 mm, tensile strength of 100 kg/mm$^2$ and elongation of 12%, and a high-chromium cast iron melt having the following composition by weight:

C: 2.70%
Si: 0.71%
Mn: 0.96%
Cr: 18.50%
Mo: 1.23%
V: 1.02%
Ni: 0.82%
Fe: Bal.

by a continuous shell casting method using the mold assembly as shown in FIG. 1.

The casting conditions were that the core was preheated to 600° C., and the melt at 1600° C. was poured into the gap between the mold assembly and the core (see FIG. 1) to form a shell continuously around the core at a rate of about mm/min. The resulting shell had a thickness of 150 mm. The resulting compound roll was heat-treated as follows:

Heating at 1050° C. for 4 hours,
Quenching with mist to 600° C.,
Slowly cooling, and then
Tempering.

The shell had Shore hardness of 70–72 which suffered from substantially no drop from surface to 100-mm depth. No thermal cracks were observed on the core, either.

The compound roll was cut at 200 mm from a roll end and examined with respect to the bonding strength between the core and the shell. Breakage took place on the side of the high-chromium cast iron shell at 63 kg/mm$^2$. Thus, it has been appreciated that the core and the shell were metallurgically bonded to each other.

This roll was further tested with respect to adhesion of rolled materials and surface roughening. A test piece of 60 mm in diameter and 10 mm in length was machined from the shell of the compound roll. An opposing roll used for this test had the same size and was made of stainless steel (SUS 304). The test was carried out by using a two-cylinder rolling fatigue test mahcine under the following conditions:

Contact pressure: 40 kg/mm$^2$
Roll side Temp.: 650° C.±30° C.

For comparison, the same test was conducted on a high-Ni content, high-chromium cast iron compound roll (Ni: 2.30 weight %) having Shore hardness of 73. The results are shown in Table 1.

TABLE 1

| No. | Ni content (wt %) | Shore Hardness | Thickness of adhered material (μm) | Surface Roughness |
|---|---|---|---|---|
| 1 | 0.82 | 73 | 12 | Small |
| 2 | 2.30 | 73 | 37 | Relatively Large |

It is apparent from the above results that the compound roll according to the present invention is superior in resistance to adhesion of rolled materials and to surface roughness.

EXAMPLE 3

A compound roll was prepared from forged chromium-molybdenum steel (SCM) having tensile strength of 83 kg/mm$^2$ and elongation of 12% as a core material, and as a shell material high-chromium cast iron having the following composition by weight:

C: 2.90%
Si: 0.64%
Mn: 0.82%
Ni: 1.49%
Cr: 18.37%
Mo: 3.26%
Fe: Bal.

The resulting compound roll had the following sizes:

Diameter of roll body: 450 mm
Length of roll body: 1000 mm
Total length of roll: 2000 ml
Diameter of core: 350 mm The mold assembly of FIG. 1 was used to manufacture this compound roll. After the shell casting, annealing was carried out at 650° C. for 5 hours. The compound roll was then heat-treated as follows:

Heating at 1000° C. for 5 hours.
Quenching from 1000° C. to 500° C. over 80 minutes.
Heating to 500° C. and keeping for 5 hours for tempering.
Slowly cooling.

The shell of the compound roll thus heat-treated had Shore hardness of 96–97 at the surface and Shore hardness of 93–95 at the 42-mm depth. The shell matrix was predominantly stable martensite with only 2% or less of residual austenite.

The compound roll was cut 200 mm inside a roll body end thereof to examine the bonding strength between the core and the shell. Breakage took place on the shell side at 63 kg/mm$^2$.

EXAMPLE 4

The compound roll of Example 3 was tested with respect to wear resistance. A test piece of 60 mm in diameter and 10 mm in length was machined from the shell of the compound roll, and the wear test was conducted in combination with a cylindrical body of the same size made of S20C (Shore hardness: 28) by a rolling wear test machine. For comparison, a roll of the same size (Shore hardness: 85) made from the same high-chromium cast iron by a centrifugal casting method was tested. The test conditions were as follows:

Rotation: $10^6$ at 3000 rpm
Contact pressure: 80 kg/mm$^2$
Slip ratio: 12.9%
Lubricant: Tallow emulsion, one drop/0.6 sec.

The amount of wear measured was 21 mg for the roll according to the present invention and 37 mg for that made by the centrifugal casting method.

As mentioned above, the compound roll of the present invention has high resistance to wear and spalling. Since the spalling is effectively prevented by residual compressive stress which serves to prevent cracks such as heat cracks from growing deep in the shell, substantially no damage is inflicted on rolled sheets. The compound roll of the present invention further has high resistance to adhesion of rolled materials and surface roughening, and its core is highly resistant to breakage even under severe rolling pressure and bending force because of its high tensile strength and elongation. Because of these characteristics, the compound roll of the present invention enjoys a long roll life.

What is claimed is:

1. A compound roll for rolling composed of a shell made of high-chromium cast iron and a core made of cast or forged steel, said shell being metallurgically bonded to said core by casting a high-chromium cast iron melt around the already prepared core, and said shell having a residual compressive stress of at least 20kg/mm$_2$ imparted by a heat treatment comprising quenching.

2. The compound roll for hot rolling according to claim 1, wherein the residual compressive stress of said shell is imparted by heat treatment comprising quenching from heating temperature to 550°–600° C. over 30–60 minutes.

3. The compound roll for rolling according to claim 2, wherein said heating temperature is 950°–1050° C.

4. The compound roll for rolling according to claim 2, wherein said heating temperature is 1000–1100° C.

5. The compound roll for hot rolling according to claim 2, wherein said shell is made of high-chromium cast iron consisting essentially, by weight, of 2.0–3.5% of C, 0.5–1.5% of Si, 0.4–1.5% of Mn, 8–25% of Cr, 0.5–3.0% of Mo, 1.5% or less of Ni and the balance being essentially Fe and having Shore hardness of 70 or more, Shore hardness drop across the depth of said shell being 3 or less per 100mm, and said core being made of cast or forged steel having tensile strength of 55 kg/mm$^2$ or more and elongation of 1.0% or more.

6. The compound roll for hot rolling according to claim 5, wherein said high-chromium cast iron further contains up to 10% by weight of V.

7. The compound roll for hot rolling according to claim 5, wherein said shell is bonded to said core with bonding strength at least equal to or higher than the strength of either weaker one of said shell and said core.

8. The compound roll for hot rolling according to claim 6, wherein said shell is bonded to said core with bonding strength at least equal to or higher than the strength of either weaker one of said shell and said core.

9. The compound roll for hot rollig according to claim 3, wherein when said core has a defect, its fracture toughness is $$\left(\frac{2}{\pi}\right) \times 55 \times \sqrt{\pi x r}\ \text{kg/mm}^{3/2}$$

or more, wherein r represents a radius of an assumptive disc equivalent to said defect in perpendicular to the direction of tension.

10. The compound roll for cold rolling according to claim 4, wherein said shell is made of high-chromium cast iron consisting essentially, by weight, of 2.5–3.5% of C, 0.5–1.5% of Si, 0.4–1.5% of Mn, 0.5–3.0% of Ni, 8–25% of Cr, 1.0–5.0% of Mo and the balance being essentially Fe and having Shore hardness of 90 or more, and said core is made of cast or forged steel having tensile strength of 55 kg/mm$^2$ or more and elongation of 1.0% or more.

11. The compound roll for cold rolling according to claim 10, wherein said high-chromium cast iron further contains up to 10% by weight of V.

12. The compound roll for cold rolling according to claim 10, wherein said shell is bonded to said core with bonding strength at least equal to or higher than the strength of either weaker one of said shell and said core.

13. The compound roll for cold rolling according to claim 9, wherein said shell is bonded to said core with bonding strength at least equal to or higher than the strength of either weaker one of said shell and said core.

14. The compound roll for cold rolling according to claim 4, wherein when said core has a defect, its fracture toughness is $$\left(\frac{2}{\pi}\right) \times 55 \times \sqrt{\pi x r}\ \text{kg/mm}^{3/2}$$

or more, wherein r represents a radius of an assumptive disc equivalent to said defect in perpendicular to the direction of tension.

* * * * *

UNITED STATES PATENT AND TRADEMARK OFFICE

CERTIFICATE OF CORRECTION

PATENT NO. : 4,721,153

DATED : January 26, 1988

INVENTOR(S) : Sano et al.

It is certified that error appears in the above-identified patent and that said Letters Patent is hereby corrected as shown below:

Claim 1: Column 10, line 22, "$20kg/mm_2$" should read --$20kg/mm^2$--.

Claim 9: Column 10, line 53, "rollig" should read --rolling--.

Signed and Sealed this

Second Day of August, 1988

*Attest:*

DONALD J. QUIGG

*Attesting Officer*

*Commissioner of Patents and Trademarks*